US005939651A

United States Patent [19]

Isobe et al.

[11] Patent Number: 5,939,651

[45] Date of Patent: Aug. 17, 1999

[54] TITANIUM-BASED ALLOY

[75] Inventors: Kazutaka Isobe; Nobuyuki Kitagawa, both of Hyogo; Isao Yamazaki, Hokkaido, all of Japan

[73] Assignees: Sumitomo Electric Industries, Ltd., Osaka; Hokkaido Sumiden Precision Industries, Ltd., Sorachi-gun, both of Japan

[21] Appl. No.: 09/060,556

[22] Filed: Apr. 15, 1998

[30] Foreign Application Priority Data

| | | | |
|---|---|---|---|
| Apr. 17, 1997 | [JP] | Japan | 9-100217 |
| Apr. 24, 1997 | [JP] | Japan | 9-107301 |
| Apr. 24, 1997 | [JP] | Japan | 9-107302 |
| Apr. 24, 1997 | [JP] | Japan | 9-107303 |

[51] Int. Cl.[6] ..... C22C 29/00

[52] U.S. Cl. ..... 75/236; 75/238; 75/242; 75/244

[58] Field of Search ..... 75/236, 238, 242, 75/244

[56] References Cited

U.S. PATENT DOCUMENTS

| | | | |
|---|---|---|---|
| 5,395,421 | 3/1995 | Weinl et al. | 75/238 |
| 5,421,851 | 6/1995 | Oskarsson et al. | 75/238 |
| 5,766,742 | 6/1998 | Nakamura et al. | 428/210 |

FOREIGN PATENT DOCUMENTS 62-170452 7/1987 Japan .

*Primary Examiner*—Ngoclan Mai
*Attorney, Agent, or Firm*—W. F. Fasse; W. G. Fasse

[57] ABSTRACT

A titanium carbonitride-based alloy which is excellent in chipping resistance and wear resistance is disclosed. A hard phase is a carbide (TiMC), a nitride (TiMN) or a carbonitride (TiMCN) of Ti and at least one metal (M), other than Ti, selected from those belonging to the groups IVa, Va and VIa of the periodic table. A binder phase contains Co and Ni as main components. When the structure of the titanium-based alloy is observed with a scanning electron microscope, particles forming the hard phase in the alloy have black core parts which are located on core portions to appear black and peripheral parts which are located around the black core parts to appear gray. Assuming that A and B represent particles having the black core parts occupying areas of at least 30% of the overall particles A and those having the black core parts occupying areas of not more than 30% of the overall particles B respectively, the area ratio of the particles A to the particles B satisfies a condition of $0.3 \leqq A/(A+B) \leqq 0.8$.

6 Claims, 3 Drawing Sheets

TITANIUM-BASED ALLOY

BACKGROUND OF THE INVENTION

1. Field of the Invention

The present invention relates to a titanium-based alloy consisting of a hard phase, a binder phase and unavoidable impurities, and more particularly, it relates to a titanium carbonitride-based alloy which is excellent in chipping resistance and wear resistance.

2. Description of the Prior Art

A titanium carbonitride-based alloy (cermet), which is superior in oxidation resistance and wear resistance to a WC-based alloy, is widely applied to a cutting tool. However, the conventional cermet having the aforementioned advantages is readily mechanically chipped.

When observing the structure of the conventional cermet with a scanning electron microscope, it is observed that particles forming the hard phase in the alloy have black core parts which are located on core portions to appear black and peripheral parts which are located around the black core parts to appear gray. In every hard phase particle, the ratio of the area of the black part to that of the peripheral part is substantially constant. If the areas of the black core parts in the respective particles are relatively large, the alloy is improved in wear resistance but deteriorated in chipping resistance. If the areas of the black parts in the respective particles are small, on the other hand, the alloy is improved in chipping resistance but deteriorated in wear resistance. It is difficult for the conventional cermet to have excellent characteristics in both of chipping resistance and wear resistance.

Japanese Patent Laying-Open No. 62-170452 (1987) discloses cermet comprising a hard phase having a cored structure. The hard phase consists of particles having black core portions and those having white core portions. The black core portions have abundance of a metal such as Ti belonging to the group IVa of the periodic table, and the white core portions have abundance of a metal such as W belonging to the group Va or VIa. In the cermet disclosed in the aforementioned gazette, the hard phase particles having the black core portions and those having the white core portions are dispersed in a constant ratio. However, the hard phase particles having the white core portions hardly contribute to wear resistance of the cermet. The hard phase particles having the white core portions occupy a large ratio of 50 to 80% with respect to the overall hard phase, to result in insufficient wear resistance of the cermet.

SUMMARY OF THE INVENTION

An object of the present invention is to provide a titanium-based alloy exhibiting excellent characteristics in both of wear resistance and chipping resistance.

Another object of the present invention is to provide a titanium-based alloy for a cermet cutting tool having a long usable life.

Still another object of the present invention is to provide a titanium carbonitride-based alloy for a cermet cutting tool exhibiting excellent characteristics in both of wear resistance and chipping resistance and having a long usable life.

A titanium-based alloy to be premised for the present invention consists of 80 to 95 percent by weight of a hard phase, a binder phase, and unavoidable impurities. The hard phase is a carbide (TiMC), a nitride (TiMN) or a carbonitride (TiMCN) of Ti and at least one metal (M), other than Ti, selected from those belonging to the groups IVa, Va and VIa of the periodic table. The binder phase contains Co and Ni as main components. When observing the structure of the titanium-based alloy with a scanning electron microscope, particles forming the hard phase in the alloy have black core parts which are located on core portions to appear black and peripheral parts which are located around the black core parts to appear gray.

According to an aspect of the present invention, the area ratio of particles A having black core parts occupying areas of at least 30% of the overall particles to particles B having black core parts occupying areas of less than 30% of the overall particles satisfies a condition of $0.3 \leqq A/(A+B) \leqq 0.8$.

The titanium-based alloy contains 80 to 95 percent by weight of the hard phase, to exhibit excellent characteristics in wear resistance, plastic deformation resistance, strength and toughness. If the content of the hard phase is less than 80 percent by weight, the alloy is remarkably deteriorated in wear resistance and plastic deformation resistance. If the content of the hard phase exceeds 95 percent by weight, on the other hand, the alloy is deteriorated in strength and toughness. The content of the hard phase is more preferably in the range of 83 to 92 percent by weight.

The metal other than Ti is properly selected from metals such as Zr and Hf belonging to the group IVa of the periodic table, V, Nb and Ta belonging to the group Va, and Mo and W belonging to the group VIa.

The particles A having the black core parts occupying large areas abundantly contain a carbide or a carbonitride of Ti in the core portions, thereby contributing to improvement of wear resistance and oxidation resistance. The particles B having the black core parts occupying small areas solidly dissolve or contain a metal such as W belonging to the group VIa of the periodic table abundantly in the peripheral parts, thereby contributing to improvement of strength and chipping resistance. Therefore, the titanium-based alloy can be improved in both of wear resistance and chipping resistance by containing the particles A and B in coexistence and making the best use of the above functions.

The area ratio of the particles A having the black core parts occupying areas of at least 30% to the particles B having the black core parts occupying areas of less than 30% satisfies the condition of $0.3 \leqq A/(A+B) \leqq 0.8$, in order to attain excellent characteristics in wear resistance, oxidation resistance and chipping resistance. If the ratio A/(A+B) is less than 0.3, the content of the particles A having the black core parts occupying large areas and containing Ti in abundance is reduced, to result in inferior wear resistance and oxidation resistance. If the ratio A/(A+B) exceeds 0.8, on the other hand, the content of the particles B having the peripheral parts occupying large areas and containing the metal such as W belonging to the group VIa in abundance is reduced. Thus, the titanium-based alloy cannot suppress propagation of cracks, to result in inferior chipping resistance.

According to another aspect of the present invention, the mean area of the black core parts of the particles A having the black core parts occupying areas of at least 30% of the overall particles is within the range of 0.8 to 2.5 $\mu m^2$, and the mean area of the black core parts of the particles B having the black core parts occupying areas of less than 30% of the overall particles is within the range of 0.1 to 0.7 $\mu m^2$. In a preferred embodiment, the area ratio of the particles A to the particles B satisfies the condition of $0.3 \leqq A/(A+B) \leqq 0.8$.

The particles A mainly contribute to wear resistance. If the mean area of the black parts of the particles A exceeds 2.5 $\mu m^2$, however, the ratio of the black core parts, having abundance of Ti, contained in the hard phase is increased to improve wear resistance, while the areas of the peripheral parts are so reduced that propagation of cracks cannot be suppressed, to result in inferior chipping resistance. If the mean area of the black core parts of the particles A is less than 0.8 $\mu m^2$, on the other hand, the ratio of the black core parts contained in the hard phase is reduced, to result in inferior wear resistance. Therefore, the mean area of the black core parts of the particles A is preferably within the range of 0.8 to 2.5 $\mu m^2$.

The particles B mainly contribute to chipping resistance. If the mean area of the black core parts of the particles B exceeds 0.7 $\mu m^2$, the areas of the peripheral parts are reduced to result in inferior chipping resistance. If the mean area of the black core parts of the particles B is less than 0.1 $\mu m^2$, on the other hand, the ratio of the black core parts contained in the hard phase is reduced to result in inferior wear resistance, although the areas of the peripheral parts are increased to improve chipping resistance. Therefore, the mean area of the black core parts of the particles B is preferably within the range of 0.1 to 0.7 $\mu m^2$.

According to still another aspect of the present invention, the area ratio of the mean area Sa of the particles A having the black core parts occupying areas of at least 30% of the overall particles to the mean area Sb of the particles B having the black core parts occupying areas of less than 30% of the overall particles satisfies a condition of $0.1 \leqq Sb/Sa \leqq 0.9$. In a preferred embodiment, the area ratio of the particles A to the particles B satisfies the condition of $0.3 \leqq A/(A+B) \leqq 0.8$.

If the ratio Sb/Sa is less than 0.1, the ratio of the black parts, having abundance of Ti, contained in the hard phase is reduced, to result in inferior wear resistance and oxidation resistance. If the ratio Sb/Sa exceeds 0.9, on the other hand, the ratio of the black core parts, having abundance of Ti, contained in the hard phase is increased to improve wear resistance, while the areas of the peripheral parts are so reduced that propagation of cracks cannot be suppressed, to result in inferior chipping resistance. Therefore, the ratio Sb/Sa is preferably within the range of 0.1 to 0.9.

According to a further aspect of the present invention, the distribution of the areas of the black parts in the respective hard phase particles has a first peak which is within the range of 0.1 to 0.7 $\mu m^2$ and a second peak which is within the range of 0.8 to 2.5 $\mu m^2$.

When the distribution of the areas of the black core parts has the first and second peaks as described above, the characteristics of particles which are distributed to have the first peak can differ from those of particles which are distributed to have the second peak. The particles which are distributed to have the first peak exhibit excellent characteristics in wear resistance, due to large areas of the peripheral parts. On the other hand, the particles which are distributed to have the second peak exhibit excellent characteristics in wear resistance, due to large areas of the black core parts.

If the area distribution of the black core parts has only one peak, all hard phase particles exhibit similar characteristics, and cannot take charge of different functions. Consequently, the titanium-based alloy is insufficient in wear resistance or chipping resistance.

If both of the first and second peaks exceed 0.7 $\mu m^2$ or one of the peaks exceeds 2.5 $\mu m^2$, the areas of the peripheral parts are so reduced that propagation of cracks cannot be suppressed, to result in inferior chipping resistance. If both of the first and peaks are less than 0.8 $\mu m^2$ or one of the peaks is less than 0.1 $\mu m^2$, the areas of the black core parts having abundance of Ti are reduced, to result in insufficient wear resistance. Thus, the area distribution of the black core parts in the hard phase particles must include the first peak which is within the range of 0.1 to 0.7 $\mu m^2$ and the second peak which is within the range of 0.8 to 2.5 $\mu m^2$.

According to the present invention, as hereinabove described, the titanium-based alloy contains the hard phase particles A having the black parts occupying large areas and the hard phase particles B having the black parts occupying small areas in the optimum ratio for effectively utilizing the characteristics exhibited by these particles A and B, thereby attaining excellent characteristics in wear resistance and chipping resistance. While a cutting tool for roughing is chipped if the same is prepared from a conventional titanium carbonitride-based alloy, the titanium-based alloy according to the present invention is also applicable to such a tool for roughing. Thus, the present invention provides a titanium carbonitride-based alloy for a cermet cutting tool having a long usable life.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

FIGS. 1 to 4 typically illustrate the structures of sections of a titanium carbonitride-based alloy according to an embodiment of the present invention observed with a scanning electron microscope. The titanium carbonitride-based alloy consists of 80 to 95 percent by weight of a hard phase, a binder phase and unavoidable impurities. FIGS. 1 to 4 illustrate only the hard phase, while omitting illustration of the binder phase and the unavoidable impurities.

The hard phase is a carbide (TiMC), a nitride (TiMN) or a carbonitride (TiMCN) of Ti and at least one metal (M), other than Ti, selected from those belonging to the groups IVa, Va and VIa of the periodic table. The binder phase contains Co and Ni as main components.

When observing the titanium-based alloy with the scanning electron microscope, it is recognized that particles forming the hard phase in the alloy have black core parts 1 which are located on core portions to appear black and peripheral parts 2 which are located around the black core parts 1 to appear gray, as shown in FIGS. 1 to 4. As described above, the black core parts 1 abundantly contain a carbide or a carbonitride of Ti. On the other hand, the peripheral parts 2 abundantly contain a metal such as W belonging to the group VIa of the periodic table.

It is assumed that A represents particles having the black parts 1 occupying areas of at least 30% of the overall particles, and B represents particles having the black parts 1 occupying areas of less than 30% of the overall particles.

In a preferred embodiment, the area ratio of the particles A to the particles B satisfies a condition of $0.3 \leqq A/(A+B) \leqq 0.8$.

In another preferred embodiment, the mean area of the black parts 1 in the particles A is within the range of 0.8 to 2.5 $\mu m^2$, and the mean area of the black parts 1 of the particles B is within the range of 0.1 to 0.7 $\mu m^2$. In still another preferred embodiment, the area ratio of the mean area Sa of the black parts 1 in the particles A to the mean area Sb of the black parts 1 in the particles B satisfies a condition of $0.1 \leqq Sb/Sa \leqq 0.9$.

Figure 5:
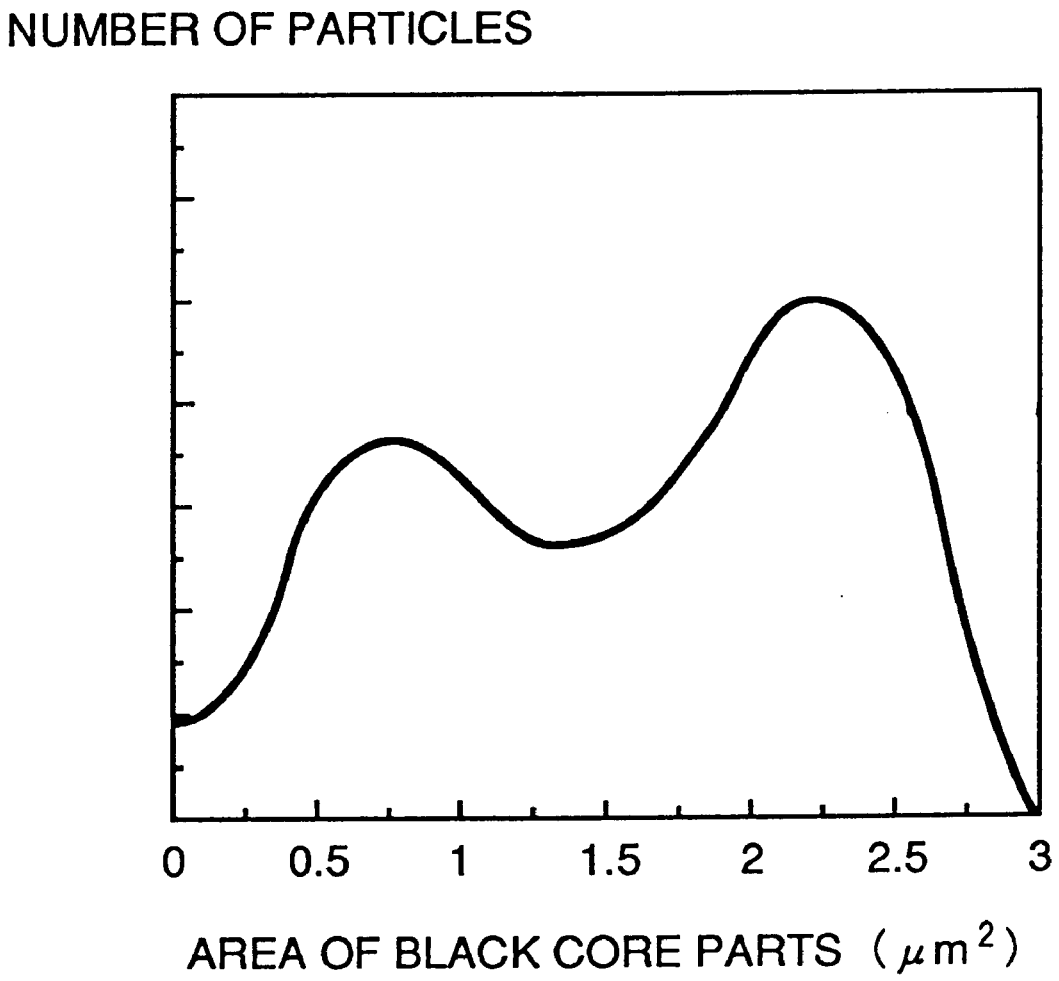
FIG. 5 illustrates the distribution of areas of black core parts.

In a further preferred embodiment, the distribution of the areas of the black core parts 1 in the respective hard phase particles includes a first peak which is within the range of 0.1 to 0.7 $\mu m^2$ and a second peak which is within the range of 0.8 to 2.5 $\mu m^2$, as shown in FIG. 5.

The areas of the particles and the black core parts 1 can be calculated by polishing a section of the alloy and observing the polished section with a scanning electron microscope. The areas can be calculated with the naked eye or by image processing in the following procedure:

(1) First, the cermet alloy is polished for taking a structural photograph of 4800 magnifications with a scanning electron microscope.

(2) Grain boundaries are identified in a region of 14 $\mu m$ by 17 $\mu m$, for loading the data in a computer with an image scanner.

(3) The numbers of pixels occupied by black core parts and peripheral parts of the identified particles, for obtaining the area of one pixel from the magnification. Further, the areas of the black core parts and the peripheral parts are obtained.

(4) The particles are classified into the particles A and B on the basis of the areas of the black core parts and the peripheral parts.

(5) The distribution of the areas of the black core parts in the particles A and B is obtained, for calculating the mean areas of the black core parts in the particles A and B respectively.

(6) The areas of the particles A and B are obtained from the numbers of pixels occupied by the particles A and B respectively, for obtaining the ratios of the particles A and B contained in the hard phase respectively.

Figure 1:
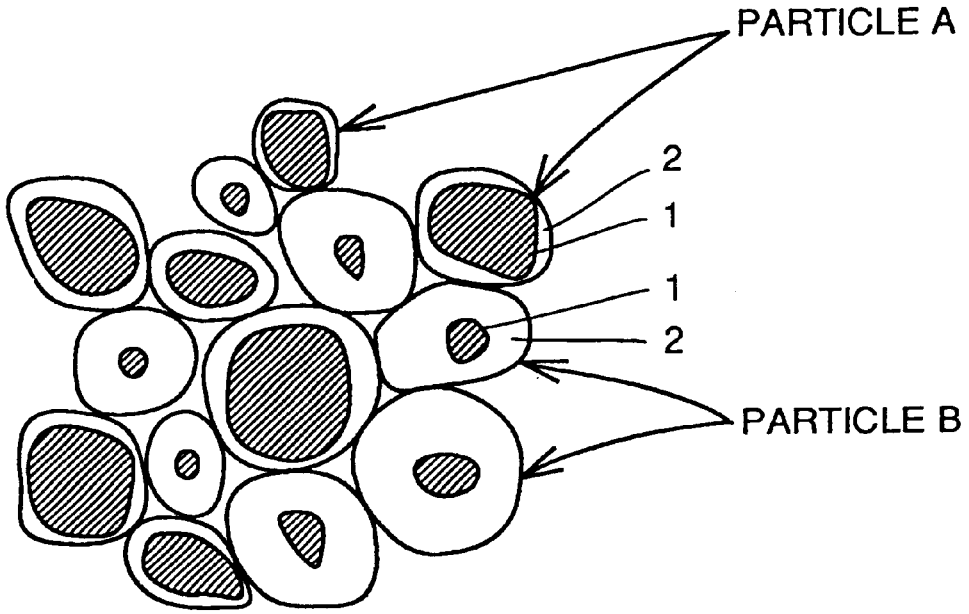
FIG. 1 illustrates exemplary distributed states of particles A having black core parts occupying large areas and particles B having black core parts occupying small areas.

In actual observation with the scanning electron microscope, the hard phase particles can be classified into the particles A having the black core parts 1 occupying large areas and the particles B having the black core parts 1 occupying small areas, as shown in FIG. 1. In the particles B, the peripheral parts 2 occupy large areas. Ten fields of the region of 14 $\mu m$ by 17 $\mu m$ are image-analyzed on the photograph of 4800 magnifications for classifying the hard phase particles into the particles A having the black core parts 1 occupying large areas and the particles B having the black core parts 1 occupying small areas, thereby obtaining the distribution of the areas of the black core parts 1 in the respective particles A and B. Thus, the mean areas of the black core parts 1 in the particles A and B are obtained. The graph shown in FIG. 5 is obtained from the distribution of the areas of the black core parts 1.

Figure 2:
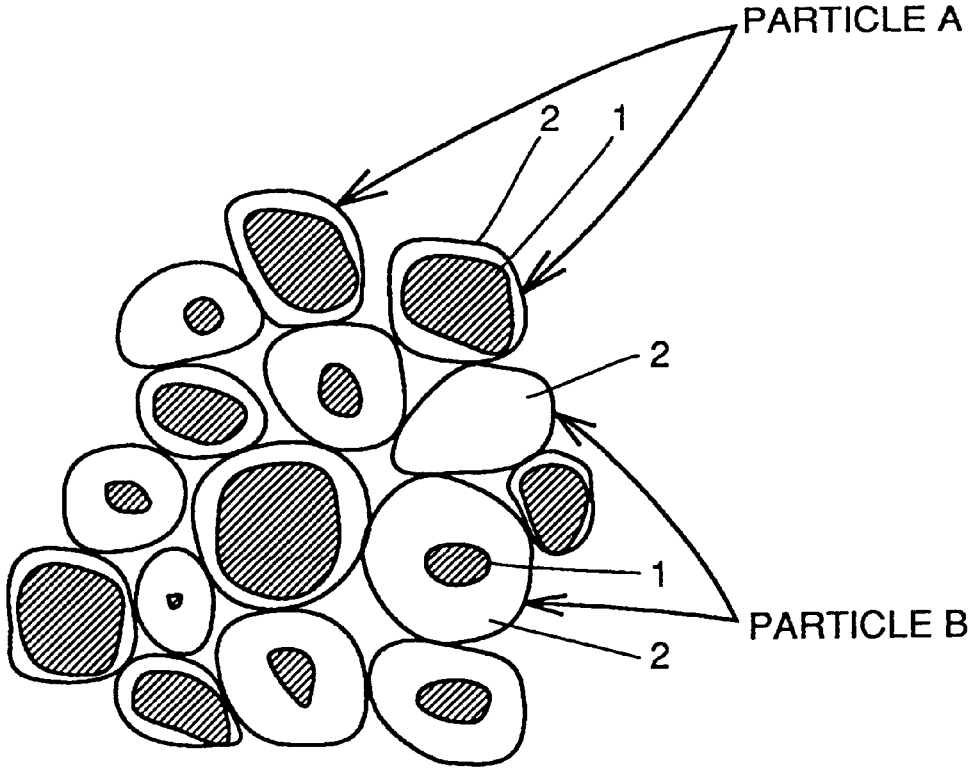
FIG. 2 illustrates other exemplary distributed states of particles A and B.
Figure 3:
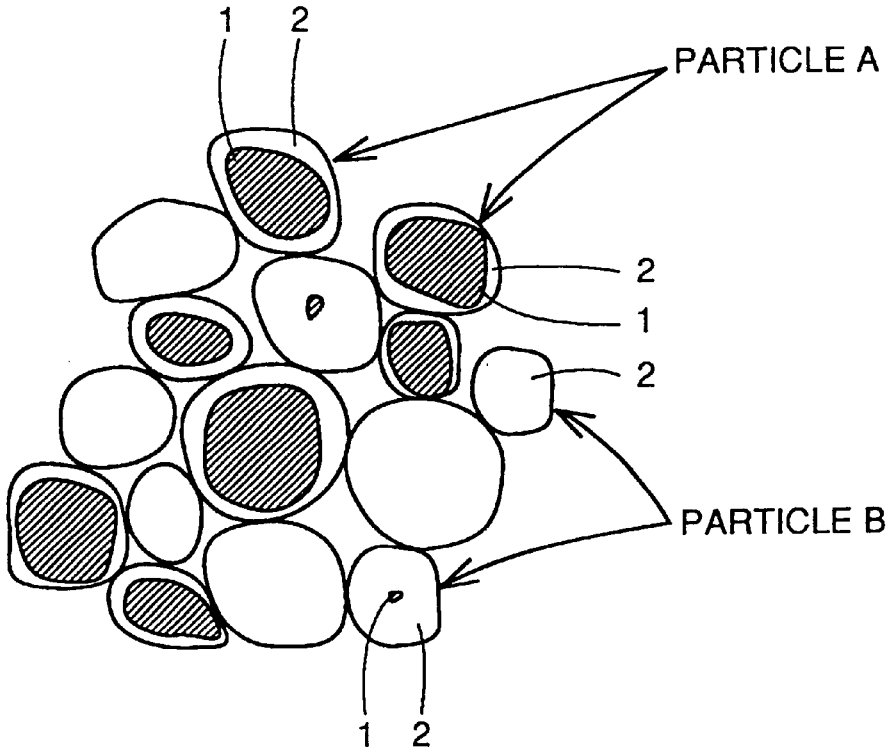
FIG. 3 illustrates further exemplary distributed states of particles A and B.
Figure 4:
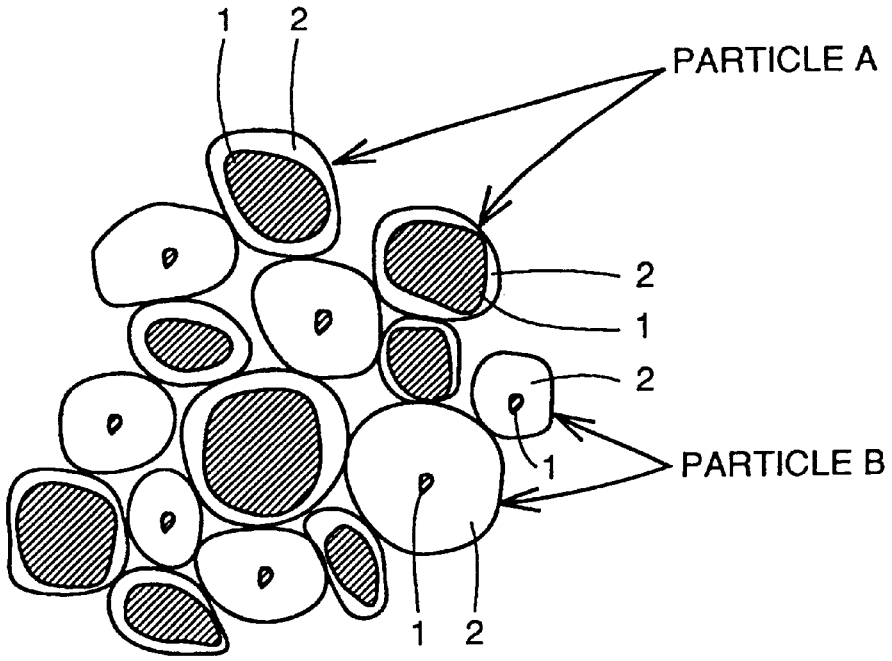
FIG. 4 illustrates further exemplary distributed states of particles A and B.

Referring to FIGS. 2 and 3, particles having no black core parts 1 are also regarded as the particles B having the black core parts 1 occupying areas of less than 30%.

The inventive titanium-based alloy, typically a titanium carbonitride-based alloy, is prepared as follows:

First, a Ti compound such as TiCN or TiC is mixed with a carbide, a nitride or a carbonitride containing a metal (M), other than Ti, belonging to the group IVa, Va or VIa of the periodic table in a prescribed ratio. At this time, the content of the Ti compound is preferably 85 to 95 percent by weight with respect to the overall mixture.

Then, the mixture is heat-treated in a nitrogen atmosphere at a relatively low temperature of 1500 to 1600° C., for example, for preparing a solid solution α.

Another mixture of another blending ratio is prepared separately from the mixture of the aforementioned blending ratio. This mixture is preferably so prepared that the content of a Ti compound is 50 to 60 percent by weight with respect to the mixture. If the mixture contains no W compound, a W compound is added to the mixture in a prescribed blending ratio, and this mixture is heat-treated in a nitrogen atmosphere at a relatively high temperature of 1750 to 1850° C., for example, for preparing a solid solution β.

The two solid solutions α and β, WC which is added at need, and Co and Ni which are iron family metals are wet-blended with each other, for forming a compact. This compact is degassed in a vacuum at a temperature of 1150 to 1250° C., and thereafter sintered at a nitrogen gas partial pressure of 1 to 200 Torr at a temperature of 1450 to 1550° C. for 1 to 2 hours.

EXAMPLE 1

70 percent by weight of TiCN, 20 percent by weight of TiC, 5 percent by weight of TaC and 5 percent by weight of NbC were blended with each other, and the obtained mixture was thereafter heat-treated in a nitrogen atmosphere of 1 atm. at a relatively low temperature of 1550° C., for preparing a solid solution (hereinafter referred to as "solid solution α"). This solid solution a was recognized to be effective for forming particles A having black core parts occupying large areas.

Separately from the solid solution α, 44 percent by weight of TiCN, 10 percent by weight of TiC, 8 percent by weight of TaC, 8 percent by weight of NbC and 30 percent by weight of WC were blended with each other, and the obtained mixture was thereafter heat-treated in a nitrogen atmosphere of 1 atm. at a temperature of 1800° C., for preparing a solid solution (hereinafter referred to as "solid solution β"). It was recognized that areas of peripheral parts were increased due to the addition of WC. The solid solution β was recognized to be effective for forming particles B.

The solid solutions α and β, WC, Co and Ni were wet-blended with each other in blending ratios shown in Table 1, and the obtained mixtures were embossed for preparing compacts. These compacts were degassed in a vacuum of $10^{-2}$ Torr at a temperature of 1200° C., and thereafter sintered at a nitrogen gas partial pressure of 1 to 200 Torr at a temperature of 1500° C. for 1 hour, thereby preparing inventive samples Nos. 1 to 6 and comparative samples Nos. 7 to 14.

TABLE 1

| Sample No | Solid Solution α (wt %) | Solid Solution β (wt %) | WC (wt %) | Co (wt %) | Ni (wt %) | Particle Area Ratio A/(A + B) | Remarks |
|---|---|---|---|---|---|---|---|
| 1 | 17 | 56 | 14 | 6.5 | 6.5 | 0.32 | inventive |
| 2 | 61 | 12 | 14 | 6.5 | 6.5 | 0.74 | inventive |
| 3 | 40 | 33 | 14 | 6.5 | 6.5 | 0.53 | inventive |
| 4 | 65 | 13 | 14 | 5 | 3 | 0.75 | inventive |
| 5 | 20 | 49 | 14 | 9 | 8 | 0.35 | inventive |
| 6 | 50 | 37 | 0 | 6.5 | 6.5 | 0.60 | inventive |
| 7 | 73 | 0 | 14 | 6.5 | 6.5 | *0.95 | comparative |
| 8 | 68 | 5 | 14 | 6.5 | 6.5 | *0.84 | comparative |
| 9 | 0 | 73 | 14 | 6.5 | 6.5 | *0.00 | comparative |
| 10 | 10 | 63 | 14 | 6.5 | 6.5 | *0.22 | comparative |
| 11 | 12 | 66 | 14 | 5 | 3 | *0.25 | comparative |
| 12 | 64 | 5 | 14 | 9 | 8 | *0.83 | comparative |
| 13 | 45 | 37 | 14 | *2 | *2 | 0.54 | comparative |
| 14 | 36 | 28 | 14 | *11 | *11 | 0.56 | comparative |

*out of inventive range

Referring to Table 1, it is inferred that the ratios $\alpha/(\alpha+\beta)$ of the solid solutions α and β are not coincident with the area ratios A/(A+B) of the particles A and B since the solid solutions α and β are expressed in weight ratios while the particles A and B are expressed in area ratios, independently blended WC is solidly dissolved in peripheral structures of the solid solutions α and β to form the particles B, and WC itself independently exists or changes to the particles B.

(Evaluation of Sintered Bodies)

The obtained sintered bodies were surface-ground and buffed, and thereafter 10 fields of photographs of 4800 magnifications taken with a scanning electron microscope were image-analyzed. Thus, the hard phases were classified into particles A and B, and the areas of these particles A and B were calculated for obtaining the area ratios of the particles A occupying the hard phases, i.e., the ratios A/(A+B).

(Cutting Test)

Then, the samples Nos. 1 to 14 were subjected to prescribed grinding and honing, for testing wear resistance and chipping resistance.

Wear Resistance Test

Tool Shape: SNMG432

Workpiece: round bar of SCM435 (HB=240)

Cutting Speed: 200 m/min.

Feed Rate: 0.3 mm/rev.

Depth of Cut: 2.0 mm

Cutting Oil: water-soluble

Cutting Time: 10 minutes

Determination: flank wear width VB (mm)

Chipping Resistance Test

Tool Shape: SNMG432

Workpiece: fluted material of SCM435 (HB=225)

Cutting Speed: 200 m/min.

Feed. Rate: 0.25 mm/rev.

Depth of Cut: 2.0 mm

Cutting Oil: water-soluble

Determination: number of impacts leading to chipping (count)

Table 2 shows the test results.

TABLE 2

| Sample No. | Wear Resistance Test Flank Wear Width (mm) | Chipping Resistance Test Number of Impacts leading to Chipping (count) | Remarks |
|---|---|---|---|
| 1 | 0.14 | 8826 | inventive |
| 2 | 0.12 | 8162 | inventive |
| 3 | 0.12 | 8669 | inventive |
| 4 | 0.11 | 8014 | inventive |
| 5 | 0.14 | 9345 | inventive |
| 6 | 0.12 | 8258 | inventive |
| 7 | 0.11 | 1534 | comparative |
| 8 | 0.12 | 2436 | comparative |
| 9 | 0.55 | 8920 | comparative |
| 10 | 0.35 | 8769 | comparative |
| 11 | 0.28 | 7820 | comparative |
| 12 | 0.13 | 2081 | comparative |
| 13 | chipped in 6 min. | 1169 | comparative |
| 14 | plastically deformed in 8 min. | 8438 | comparative |

As clearly understood from the results shown in Table 2, abrasion loss in the wear resistance test was not more than 0.14 mm and the number of impacts leading to chipping in the chipping resistance test was at least 8000 in each of the inventive samples Nos. 1 to 6.

On the other hand, the comparative samples Nos. 7 and 8 exhibited excellent characteristics in wear resistance, but were extremely inferior in chipping resistance. The comparative samples Nos. 9 and 10 were excellent in chipping resistance but remarkably inferior in wear resistance. The comparative sample No. 11, reducing the content of the binder phase consisting of Co and Ni and increasing the ratio of the particles B contained in the hard phase, was excellent in chipping resistance but inferior in wear resistance. The comparative sample No. 12, increasing the content of the binder phase consisting of Co and Ni and increasing the ratio of the particles A contained in the hard phase, was excellent in wear resistance but inferior in chipping resistance.

The ratio of the hard phase consisting of a carbide, a nitride or a carbonitride is preferably 80 to 95 percent by weight.

EXAMPLE 2

70 percent by weight of TiCN, 14 percent by weight of TiC, 8 percent by weight of TaC and 8 percent by weight of NbC were blended with each other, and the obtained mixture was thereafter heat-treated in a nitrogen atmosphere of 1 atm. at a relatively low temperature of 1550° C., for preparing a solid solution (hereinafter referred to as "solid solution α"). This solid solution α was recognized to be effective for forming particles A having black core parts occupying large areas.

Separately from the solid solution α, 40 percent by weight of TiCN, 10 percent by weight of TiC, 8 percent by weight of TaC, 8 percent by weight of NbC and 34 percent by weight of WC were blended with each other, and the obtained mixture was thereafter heat-treated in a nitrogen atmosphere of 1 atm. at a temperature of 1800° C., for preparing a solid solution (hereinafter referred to as "solid solution β"). It was recognized that areas of peripheral parts were increased due to the addition of WC. The solid solution β was recognized to be effective for forming particles B having black core parts occupying small areas.

The solid solutions α and β, WC, and Co and Ni which are iron family metals were wet-blended with each other in blending ratios shown in Table 3, and the obtained mixtures were embossed for preparing compacts. Some of these compacts were degassed in a vacuum of $10^{-2}$ Torr at a temperature of 1200° C., and thereafter sintered at a nitrogen gas partial pressure of 1 to 200 Torr at a temperature of 1480° C. for 1 hour, thereby preparing inventive samples Nos. 21, 24 and 26 to 29 and comparative samples Nos. 32 to 37. The remaining compacts were similarly degassed in a vacuum of $10^{-2}$ Torr at a temperature of 1200° C., and thereafter sintered at a nitrogen gas partial pressure of 1 to 200 Torr at a temperature of 1530° C. for 1 hour, thereby preparing inventive samples Nos. 22, 23 and 25 to 29 and comparative samples Nos. 30 and 31.

TABLE 3

| Sample No. | Solid Solution α (wt %) | Solid Solution β (wt %) | WC (wt %) | Co (wt %) | Ni (wt %) | Mean Area of Black Core Parts in Particles A | Mean Area of Black Core Parts in Particles B | Particle Area Ratio A/(A + B) | Remarks |
|---|---|---|---|---|---|---|---|---|---|
| 21 | 40 | 27 | 20 | 6.5 | 6.5 | 1.93 | 0.45 | 0.55 | inveative |
| 22 | 35 | 32 | 20 | 6.5 | 6.5 | 1.08 | 0.15 | 0.54 | inventive |
| 23 | 35 | 36 | 16 | 6.5 | 6.5 | 1.23 | 0.23 | 0.51 | inventive |
| 24 | 45 | 32 | 10 | 6.5 | 6.5 | 2.15 | 0.57 | 0.55 | inventive |
| 25 | 42 | 45 | 0 | 6.5 | 6.5 | 2.41 | 0.65 | 0.56 | inventive |
| 26 | 20 | 53 | 14 | 6.5 | 6.5 | 1.87 | 0.43 | 0.35 | inventive |
| 27 | 63 | 10 | 14 | 6.5 | 6.5 | 1.95 | 0.39 | 0.77 | inventive |
| 28 | 68 | 10 | 14 | 5 | 3 | 1.88 | 0.53 | 0.77 | inventive |
| 29 | 15 | 54 | 14 | 9 | 8 | 1.58 | 0.29 | 0.32 | inventive |
| 30 | 38 | 24 | 25 | 6.5 | 6.5 | 0.89 | *0.08 | 0.57 | comparative |
| 31 | 25 | 27 | 35 | 6.5 | 6.5 | *0.71 | *0.06 | 0.49 | comparative |
| 32 | 42 | 40 | 5 | 6.5 | 6.5 | *2.56 | 0.67 | 0.54 | comparative |
| 33 | 40 | 47 | 0 | 6.5 | 6.5 | *2.75 | *0.86 | 0.48 | comparative |
| 34 | 69 | 8 | 10 | 6.5 | 6.5 | 2.13 | 0.51 | *0.82 | comparative |
| 35 | 10 | 59 | 18 | 6.5 | 6.5 | 2.5 | 0.53 | *0.24 | comparative |
| 36 | 42 | 40 | 14 | *2 | *2 | 2.31 | 0.61 | 0.53 | comparative |
| 37 | 34 | 30 | 14 | *11 | *11 | 1.66 | 0.25 | 0.51 | comparative |

unit of mean area of black core parts: $\mu m^2$
*out of inventive range (Evaluation of Sintered Bodies)

The obtained sintered bodies were surface-ground and buffed, and thereafter 10 fields of photographs of 4800 magnifications taken with a scanning electron microscope were image-analyzed. Thus, the hard phases were classified into particles A and B, and the area distributions of the black core parts of these particles A and B were obtained for calculating the mean areas of the black core parts of the particles A and B.

(Cutting Test)

Then, the inventive samples Nos. 21 to 29 and the comparative samples Nos. 30 to 37 were ground and honed, for testing wear resistance and chipping resistance under the following constant conditions:

Wear Resistance Test
- Tool Shape: SNMG432
- Workpiece: round bar of SCM435 (HB=240)
- Cutting Speed: 230 m/min.
- Feed Rate: 0.25 mm/rev.
- Depth of Cut: 2.0 mm
- Cutting Oil: water-soluble
- Cutting Time: 10 minutes
- Determination: flank wear width VB (mm)

Chipping Resistance Test
- Tool Shape: SNMG432
- Workpiece: fluted material of SCM435 (HB=225)
- Cutting Speed: 220 m/min.
- Feed Rate: 0.22 mm/rev.
- Depth of Cut: 2.0 mm
- Cutting Oil: water-soluble Determination: number of impacts leading to chipping (count)

Table 4 shows the test results.

TABLE 4

| Sample No. | Wear Resistance test Flank Wear Width (mm) | Chipping Resistance Test Number of Impacts Leading to Chipping (count) | Remarks |
|---|---|---|---|
| 21 | 0.12 | 8452 | inventive |
| 22 | 0.14 | 9542 | inventive |

TABLE 4-continued

| Sample No. | Wear Resistance test Flank Wear Width (mm) | Chipping Resistance Test Number of Impacts Leading to Chipping (count) | Remarks |
|---|---|---|---|
| 23 | 0.14 | 10544 | inventive |
| 24 | 0.11 | 8146 | inventive |

TABLE 4-continued

| Sample No. | Wear Resistance test Flank Wear Width (mm) | Chipping Resistance Test Number of Impacts Leading to Chipping (count) | Remarks |
|---|---|---|---|
| 25 | 0.09 | 8215 | inventive |
| 26 | 0.13 | 8749 | inventive |
| 27 | 0.13 | 9245 | inventive |
| 28 | 0.11 | 8454 | inventive |
| 29 | 0.15 | 9878 | inventive |
| 30 | 0.34 | 8925 | comparative |
| 31 | 0.52 | 9452 | comparative |
| 32 | 0.12 | 2157 | comparative |
| 33 | 0.09 | 1897 | comparative |
| 34 | 0.11 | 1457 | comparative |
| 35 | 0.38 | 9214 | comparative |
| 36 | chipped in 3 min. | 1347 | comparative |
| 37 | plastically deformed in 8 min. | 8547 | comparative |

As clearly understood from the results shown in Table 4, abrasion loss in the wear resistance test was not more than 0.15 mm and the number of impacts leading to chipping in the chipping resistance test was at least 8000 in each of the inventive samples Nos. 21 to 29.

On the other hand, the comparative samples Nos. 30 and 31 were excellent in chipping resistance but extremely inferior in wear resistance. The comparative samples Nos. 32 and 33 were excellent in wear resistance but remarkably inferior in chipping resistance. The comparative sample No. 34 was excellent in wear resistance but inferior in chipping resistance, due to the large ratio of the particles A. The comparative sample No. 35 was excellent in chipping resistance but inferior in wear resistance, due to the large ratio of the particles B.

EXAMPLE 3

70 percent by weight of TiCN, 14 percent by weight of TiC, 8 percent by weight of TaC and 8 percent by weight of NbC were blended with each other, and the obtained mixture was thereafter heat-treated in a nitrogen atmosphere of 1 atm. at a relatively low temperature of 1550° C., for preparing a solid solution (hereinafter referred to as "solid solution α"). This solid solution α was recognized to be effective for forming particles A having black core parts occupying large areas.

Separately from the solid solution α, 40 percent by weight of TiCN, 10 percent by weight of TiC, 8 percent by weight of TaC, 8 percent by weight of NbC and 34 percent by weight of WC were blended with each other, and the obtained mixture was thereafter heat-treated in a nitrogen atmosphere of 1 atm. at a temperature of 1800° C., for preparing a solid solution (hereinafter referred to as "solid solution β"). It was recognized that areas of peripheral parts were increased due to the addition of WC. The solid solution β was recognized to be effective for forming particles B having black core parts occupying small areas.

The solid solutions α and β, WC, and Co and Ni which are iron family metals were wet-blended with each other in blending ratios shown in Table 5, and the obtained mixtures were embossed for preparing compacts. Some of these compacts were degassed in a vacuum of $10^{-2}$ Torr at a temperature of 1200° C., and thereafter sintered at a nitrogen gas partial pressure of 1 to 200 Torr at a temperature of 1500° C. for 1 hour, thereby preparing inventive samples Nos. 41, 44 and 46 to 49 and comparative samples Nos. 51 to 56. The remaining compacts were similarly degassed in a vacuum of $10^{-2}$ Torr at a temperature of 1200° C., and thereafter sintered at a nitrogen gas partial pressure of 1 to 200 Torr at a temperature of 1540° C. for 1 hour, thereby preparing inventive samples Nos. 42, 43 and 45 and a comparative sample No. 50.

TABLE 5

| Sample No. | Solid Solution α (wt %) | Solid Solution β (wt %) | WG (wt %) | Co (wt %) | Ni (wt %) | Area Ratio of Black Core Parts Sb/Sa | Particle Area Ratio A/(A + B) | Remarks |
|---|---|---|---|---|---|---|---|---|
| 41 | 37 | 30 | 20 | 6.5 | 6.5 | 0.36 | 0.49 | inventive |
| 42 | 37 | 30 | 20 | 6.5 | 6.5 | 0.15 | 0.54 | inventive |
| 43 | 38 | 33 | 16 | 6.5 | 6.5 | 0.25 | 0.51 | inventive |
| 44 | 42 | 35 | 10 | 6.5 | 6.5 | 0.59 | 0.52 | inventive |
| 45 | 45 | 42 | 0 | 6.5 | 6.5 | 0.85 | 0.56 | inventive |
| 46 | 17 | 56 | 14 | 6.5 | 6.5 | 0.62 | 0.32 | inventive |
| 47 | 61 | 12 | 14 | 6.5 | 6.5 | 0.58 | 0.74 | inventive |
| 48 | 65 | 13 | 14 | 5 | 3 | 0.78 | 0.75 | inventive |
| 49 | 20 | 49 | 14 | 9 | 8 | 0.38 | 0.35 | inventive |
| 50 | 32 | 25 | 30 | 6.5 | 6.5 | *0.06 | 0.53 | comparative |
| 51 | 40 | 47 | 0 | 6.5 | 6.5 | *0.94 | 0.48 | comparative |
| 52 | 27 | 25 | 35 | 6.5 | 6.5 | *0.08 | 0.51 | comparative |
| 53 | 62 | 5 | 20 | 6.5 | 6.5 | 0.41 | *0.85 | comparative |
| 54 | 8 | 61 | 18 | 6.5 | 6.5 | 0.53 | *0.22 | comparative |
| 55 | 45 | 37 | 14 | *2 | *2 | 0.53 | 0.54 | comparative |
| 56 | 36 | 28 | 14 | *11 | *11 | 0.48 | 0.56 | comparative |

*out of inventive range (Evaluation of Sintered Bodies)

The obtained sintered bodies were surface-ground and buffed, and thereafter 10 fields of photographs of 4800 magnifications taken with a scanning electron microscope were image-analyzed. Thus, the hard phases were classified into particles A and B, and the area distributions of the black core parts of these particles A and B were obtained for calculating the mean areas of the black core parts of the particles A and B.

(Cutting Test)

Then, the inventive samples Nos. 41 to 49 and the comparative samples Nos. 50 to 56 were ground and honed, for testing wear resistance and chipping resistance under the following constant conditions:

Wear Resistance Test
Tool Shape: SNMG432
Workpiece: round bar of SCM435 (HB=240)
Cutting Speed: 220 m/min.
Feed Rate: 0.3 mm/rev.
Depth of Cut: 2.0 mm
Cutting Oil: water-soluble
Cutting Time: 10 minutes
Determination: flank wear width VB (mm)

Chipping Resistance Test
Tool Shape: SNMG432
Workpiece: fluted material of SCM435 (HB=225)
Cutting Speed: 180 m/min.
Feed Rate: 0.25 mm/rev.
Depth of Cut: 2.0 mm
Cutting Oil: water-soluble
Determination: number of impacts leading to chipping (count)

Table 6 shows the test results.

TABLE 6

| Sample No. | Wear Resistance Test Flank Wear Width (mm) | Chipping Resistance Test Number of Impacts leading to Chipping (count) | Remarks |
|---|---|---|---|
| 41 | 0.14 | 8455 | inventive |
| 42 | 0.15 | 8848 | inventive |
| 43 | 0.14 | 8669 | inventive |
| 44 | 0.12 | 8249 | inventive |
| 45 | 0.09 | 7538 | inventive |
| 46 | 0.14 | 8891 | inventive |
| 47 | 0.11 | 7654 | inventive |
| 48 | 0.10 | 7354 | inventive |
| 49 | 0.15 | 8255 | inventive |
| 50 | 0.35 | 7928 | comparative |
| 51 | 0.09 | 1689 | comparative |
| 52 | 0.48 | 8345 | comparative |
| 53 | 0.10 | 1987 | comparative |
| 54 | 0.38 | 7957 | comparative |
| 55 | chipped in 7 min. | 1169 | comparative |
| 56 | plastically deformed in 5 min. | 8438 | comparative |

As clearly understood from the results shown in Table 6, abrasion loss in the wear resistance test was not more than 0.15 mm and the number of impacts leading to chipping in the chipping resistance test was at least 7000 in each of the inventive samples Nos. 41 to 49.

On the other hand, the comparative samples Nos. 50 and 52 were excellent in chipping resistance but extremely inferior in wear resistance. The comparative sample No. 51 was excellent in wear resistance but remarkably inferior in chipping resistance. The comparative sample No. 53 was excellent in wear resistance but insufficient in chipping resistance, due to the large ratio of the particles A contained in the hard phase. The comparative sample No. 54 was excellent in chipping resistance but inferior in wear resistance, due to the large ratio of the particles B contained in the hard phase.

EXAMPLE 4

70 percent by weight of TiCN, 20 percent by weight of TiC, 5 percent by weight of TaC and 5 percent by weight of NbC were blended with each other, and the obtained mixture was thereafter heat-treated in a nitrogen atmosphere of 1 atm. at a relatively low temperature of 1550° C., for preparing a solid solution (hereinafter referred to as "solid solution α"). This solid solution a was recognized to be effective for forming particles A having black core parts occupying large areas.

Separately from the solid solution α, 44 percent by weight of TiCN, 10 percent by weight of TiC, 8 percent by weight of TaC, 8 percent by weight of NbC and 30 percent by weight of WC were blended with each other, and the obtained mixture was thereafter heat-treated in a nitrogen atmosphere of 1 atm. at a temperature of 1800° C., for preparing a solid solution (hereinafter referred to as "solid solution β"). It was recognized that areas of peripheral parts were increased due to the addition of WC. The solid solution β was recognized to be effective for forming particles B having black core parts occupying small areas.

The solid solutions α and β, WC, and Co and Ni which are iron family metals were wet-blended with each other in blending ratios shown in Table 7, and the obtained mixtures were embossed for preparing compacts. Some of these compacts were degassed in a vacuum of $10^{-2}$ Torr at a temperature of 1200° C., and thereafter sintered at a nitrogen gas partial pressure of 1 to 200 Torr at a temperature of 1500° C. for 1 hour, thereby preparing inventive samples Nos. 61, 64, 66 and 67 and comparative samples Nos. 70 to 75. The remaining compacts were similarly degassed in a vacuum of $10^{-2}$ Torr at a temperature of 1200° C., and thereafter sintered at a nitrogen gas partial pressure of 1 to 200 Torr at a temperature of 1550° C. for 1 hour, thereby preparing inventive samples Nos. 62, 63 and 65 and comparative samples Nos. 68 and 69.

TABLE 7

| Sample No. | Solid Solution α (wt %) | Solid Solution β (wt %) | WC (wt %) | Co (wt %) | Ni (wt %) | Peak Position of Area of Black Core Parts ($\mu m^2$) | | Remarks |
|---|---|---|---|---|---|---|---|---|
| 61 | 30 | 37 | 20 | 6.5 | 6.5 | 0.41 | 1.88 | inventive |
| 62 | 30 | 37 | 20 | 6.5 | 6.5 | 0.15 | 0.83 | inventive |
| 63 | 53 | 20 | 14 | 6.5 | 6.5 | 0.24 | 1.57 | inventive |
| 64 | 15 | 62 | 10 | 6.5 | 6.5 | 0.55 | 2.09 | inventive |
| 65 | 42 | 45 | 0 | 6.5 | 6.5 | 0.67 | 2.44 | inventive |
| 66 | 70 | 12 | 10 | 5 | 3 | 0.61 | 2.25 | inventive |
| 67 | 17 | 56 | 10 | 9 | 8 | 0.35 | 1.58 | inventive |
| 68 | 32 | 25 | 30 | 6.5 | 6.5 | *0.06 | 0.92 | cmparative |
| 69 | 20 | 27 | 40 | 6.5 | 6.5 | *0.04 | *0.73 | cmparative |
| 70 | 55 | 27 | 5 | 6.5 | 6.5 | 0.61 | *2.54 | cmparative |
| 71 | 50 | 37 | 0 | 6.5 | 6.5 | *0.75 | *2.71 | cmparative |
| 72 | 73 | 0 | 14 | 6.5 | 6.5 | *none | 2.05 | cmparative |
| 73 | 0 | 73 | 14 | 6.5 | 6.5 | 0.55 | *none | cmparative |
| 74 | 50 | 32 | 14 | 2 | 2 | 0.45 | 2.15 | cmparative |
| 75 | 24 | 40 | 14 | 11 | 11 | 0.35 | 1.58 | cmparative |

*out of inventive range (Evaluation of Sintered Bodies)

The obtained sintered bodies were surface-ground and buffed, and thereafter 10 fields of photographs of 4800 magnifications taken with a scanning electron microscope were image-analyzed. Thus, the area distributions of the black core parts of the particles A and B were obtained for calculating the levels and positions of peaks on the basis of the area distributions.

(Cutting Test)

Then, the inventive samples Nos. 61 to 67 and the comparative samples Nos. 68 to 75 were ground and honed, for testing wear resistance and chipping resistance under the following constant conditions:

Wear Resistance Test

Tool Shape: SNMG432
Workpiece: round bar of SCM435 (HB=220)
Cutting Speed: 170 m/min.
Feed Rate: 0.35 mm/rev.
Depth of Cut: 2.0 mm
Cutting Oil: water-soluble
Cutting Time: 10 minutes
Determination: flank wear width VB (mm)

Chipping Resistance Test

Tool Shape: SNMG432
Workpiece: fluted material of SCM435 (HB=225)
Cutting Speed: 220 m/min.
Feed Rate: 0.23 mm/rev.
Depth of Cut: 2.0 mm
Cutting Oil: water-soluble Determination: number of impacts leading to chipping (count)

Table 8 shows the test results.

TABLE 8

| Sample No. | Wear Resistance Test Flank Wear Width (mm) | Chipping Resistance Test Number of Impacts leading to Chipping (count) | Remarks |
|---|---|---|---|
| 61 | 0.11 | 9015 | inventive |
| 62 | 0.15 | 10545 | inventive |
| 63 | 0.13 | 8854 | inventive |
| 64 | 0.11 | 8256 | inventive |
| 65 | 0.09 | 8457 | inventive |
| 66 | 0.13 | 8269 | inventive |
| 67 | 0.15 | 9354 | inventive |
| 68 | 0.38 | 9345 | comparative |
| 69 | 0.45 | 9639 | comparative |
| 70 | 0.14 | 2115 | comparative |
| 71 | 0.11 | 1579 | comparative |
| 72 | 0.09 | 1854 | comparative |
| 73 | plastically deformed in 8 min. | 9866 | comparative |
| 74 | chipped in 4 min. | 1355 | comparative |
| 75 | plastically deformed in 5 min. | 9247 | comparative |

As clearly understood from the results shown in Table 8, abrasion loss in the wear resistance test was not more than 0.15 mm and the number of impacts leading to chipping in the chipping resistance test was at least 8000 in each of the inventive samples Nos. 61 to 67.

On the other hand, the comparative samples Nos. 68 and 69 were excellent in chipping resistance but extremely inferior in wear resistance due to the presence of peaks on the sides of the black core parts occupying small areas. The comparative samples Nos. 70 and 71 were excellent in wear resistance but remarkably inferior in chipping resistance due to the presence of peaks on the sides of the black core parts occupying large areas. Each of the comparative samples Nos. 72 and 73 was insufficient in wear resistance or chipping resistance, due to the presence of only one peak.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A titanium-based alloy consisting of 80 to 95 percent by weight of a hard phase, a binder phase and unavoidable impurities, wherein said hard phase is a carbide (TiMC), a nitride (TiMN) or a carbonitride (TiMCN) of Ti and at least one metal (M), other than Ti, selected from those belonging to the groups IVa, Va and VIa of the periodic table, said binder phase contains Co and Ni as main components, particles forming said hard phase in said titanium-based alloy have black core parts being located on core portions to appear black and peripheral parts being located around said black core parts to appear gray when the structure of said titanium-based alloy is observed with a scanning electron microscope, and the area ratio of particles A having said black core parts occupying areas of at least 30% of overall said particles A to particles B having said black core parts occupying areas of less than 30% of overall said particles B satisfies a condition of $0.3 \leqq A/(A+B) \leqq 0.8$.

2. A titanium-based alloy consisting of 80 to 95 percent by weight of a hard phase, a binder phase and unavoidable impurities, wherein said hard phase is a carbide (TiMC), a nitride (TiMN) or a carbonitride (TiMCN) of Ti and at least one metal (M), other than Ti, selected from those belonging to the groups IVa, Va and VIa of the periodic table, said binder phase contains Co and Ni as main components, particles forming said hard phase in said titanium-based alloy have black core parts being located on core portions to appear black and peripheral parts being located around said black core parts to appear gray when the structure of said titanium-based alloy is observed with a scanning electron microscope, and the mean area of said black core parts is within the range of 0.8 to 2.5 $\mu m^2$ in particles A having said black core parts occupying areas of at least 30% of overall said particles A and the mean area of said black core parts is within the range of 0.1 to 0.7 $m^2$ in particles B having said black core parts occupying areas of less than 30% of overall said particles B.

3. The titanium-based alloy in accordance with claim 2, wherein the area ratio of said particles A to said particles B satisfies a condition of $0.3 \leqq A/(A+B) \leqq 0.8$.

4. A titanium-based alloy consisting of 80 to 95 percent by weight of a hard phase, a binder phase and unavoidable impurities, wherein said hard phase is a carbide (TiMC), a nitride (TiMN) or a carbonitride (TiMCN) of Ti and at least one metal (M), other than Ti, selected from those belonging to the groups IVa, Va and VIa of the periodic table, said binder phase contains Co and Ni as main components, particles forming said hard phase in said titanium-based alloy have black core parts being located on core portions to appear black and peripheral parts being located around said black core parts to appear gray when the structure of said titanium-based alloy is observed with a scanning electron microscope, and the area ratio of the mean area Sa of said black core parts in particles A having said black core parts occupying areas of at least 30% of overall said particles A to the mean area Sb of said black core parts in particles B having said black core parts occupying areas of less than 30% of overall said particles B satisfies a condition of $0.1 \leqq Sb/Sa \leqq 0.9$.

5. The titanium-based alloy in accordance with claim 4, wherein the area ratio of said particles A to said particles B satisfies a condition of $0.3 \leqq A/(A+B) \leqq 0.8$.

6. A titanium-based alloy consisting of 80 to 95 percent by weight of a hard phase, a binder phase and unavoidable impurities, wherein said hard phase is a carbide (TiMC), a nitride (TiMN) or a carbonitride (TiMCN) of Ti and at least one metal (M), other than Ti, selected from those belonging to the groups IVa, Va and VIa of the periodic table, said binder phase contains Co and Ni as main components, particles forming said hard phase in said titanium-based alloy have black core parts being located on core portions to appear black and peripheral parts being located around said black core parts to appear gray when the structure of said titanium-based alloy is observed with a scanning electron microscope, and the area distribution of said black core parts in respective said particles forming said hard phase includes a first peak being within the range of 0.1 to 0.7 $\mu m^2$ and a second peak being within the range of 0.8 to 2.5 $\mu m^2$.

* * * * *

UNITED STATES PATENT AND TRADEMARK OFFICE

CERTIFICATE OF CORRECTION

PATENT NO. : 5,939,651

DATED : Aug. 17, 1999

INVENTOR(S) : Isobe et al.

It is certified that error appears in the above-identified patent and that said Letters Patent is hereby corrected as shown below:

Col. 6, line 43, after "solution", replace "a" by --α--.

Col. 12, Table 5, col. 4, in the heading, line 1, replace "WG" by --WC--.

Col. 16, line 49, after "0.1 to 07", replace "$m^2$" by --$\mu m^2$--.

Signed and Sealed this

Fifteenth Day of February, 2000

*Attest:*

*Attesting Officer*

Q. TODD DICKINSON

*Commissioner of Patents and Trademarks*